US009511617B2

(12) United States Patent
Cheng

(10) Patent No.: US 9,511,617 B2
(45) Date of Patent: Dec. 6, 2016

(54) RING BINDER MECHANISM

(71) Applicant: World Wide Stationery Mfg. Co., Ltd., Kwai Chung, New Territory, Hong Kong (CN)

(72) Inventor: Kei Cheng, Hong Kong (CN)

(73) Assignee: World Wide Stationary Mfg. Co., Ltd., Kwai Chung, New Territories (HK)

( * ) Notice: Subject to any disclaimer, the term of this patent is extended or adjusted under 35 U.S.C. 154(b) by 198 days.

(21) Appl. No.: 14/504,069

(22) Filed: Oct. 1, 2014

(65) Prior Publication Data

US 2015/0117934 A1 Apr. 30, 2015

(30) Foreign Application Priority Data

Oct. 31, 2013 (CN) ..... 2013 1 0530283
Oct. 31, 2013 (CN) ..... 2013 2 0680976 U

(51) Int. Cl.
*B42F 13/20* (2006.01)
*B42F 13/22* (2006.01)
*B42F 13/26* (2006.01)
*B42F 13/16* (2006.01)

(52) U.S. Cl.
CPC ..... *B42F 13/20* (2013.01); *B42F 13/16* (2013.01); *B42F 13/22* (2013.01); *B42F 13/26* (2013.01)

(58) Field of Classification Search
CPC ..... B42F 13/16; B42F 13/20; B42F 13/22; B42F 13/26
USPC ..... 402/29–31, 36–38, 41
See application file for complete search history.

(56) References Cited

U.S. PATENT DOCUMENTS 566,717 A 8/1896 Krah
621,256 A 3/1899 Krah
651,254 A 6/1900 Krah
683,019 A 9/1901 Buchanan
790,382 A 5/1905 McBride
854,074 A 5/1907 Bryant
(Continued)

FOREIGN PATENT DOCUMENTS

CA 2500817 A1 9/2005
EP 1431065 A1 6/2004
(Continued)

OTHER PUBLICATIONS

Kokuyo Lock Ring Mechanism with description, two instruction sheets, and nine photographs, date unknown but admitted as prior art, 12 pgs.

*Primary Examiner* — Kyle Grabowski
(74) *Attorney, Agent, or Firm* — Senniger Powers LLP

(57) ABSTRACT

A ring binder mechanism for retaining loose leaf pages has a housing and pivoting hinge plates supported by the housing. The mechanism has an actuator mounted on the housing and moveable between open and closed positions to pivot the hinge plates and thereby open and close rings of the mechanism. An elongate travel bar is operatively connected to the actuator for movement of the travel bar longitudinally in the housing by the actuator. The travel bar has a plurality of locking elements and a cam. The locking elements are positioned to block pivoting movement of the hinge plates when the actuator and rings are in the closed position and the locking elements are in a locking position. The cam extends into an opening in the hinge plates. The cam helps the actuator drive pivoting movement of the hinge plates.

21 Claims, 15 Drawing Sheets

(56) References Cited

U.S. PATENT DOCUMENTS 857,377 A 6/1907 Baker
974,831 A 11/1910 Scherzinger
1,011,391 A 12/1911 Sturgis
1,163,179 A 12/1915 Schade, Jr.
1,168,260 A 1/1916 Albrecht
1,398,034 A 11/1921 Mero
1,398,388 A 11/1921 Murphy
1,439,367 A * 12/1922 Krag ..... B42F 13/26 402/41
1,598,206 A 8/1926 Lindstedt et al.
1,733,548 A 10/1929 Martin
1,733,894 A 10/1929 Martin
1,787,957 A 1/1931 Schade
1,822,669 A 9/1931 Schade
1,824,791 A 9/1931 Rengmann
1,857,291 A 5/1932 Trussell
1,953,981 A 4/1934 Trussell
1,991,362 A 2/1935 Krag
1,996,463 A 4/1935 Dawson et al.
2,004,570 A 6/1935 Dawson
2,013,416 A * 9/1935 McClure ..... B42F 13/26 402/38
2,024,461 A 12/1935 Lotter
2,067,846 A 1/1937 Cooper
2,075,766 A 3/1937 Rand
2,081,372 A 5/1937 Thomas
2,089,211 A 8/1937 Krag
2,096,944 A 10/1937 Unger et al.
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 St. Louis et al.
2,251,878 A 8/1941 Hanna et al.
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A 12/1943 Schade
2,421,799 A 6/1947 Martin
2,528,866 A 11/1950 Dawson, Jr.
2,543,866 A 3/1951 Panfil, Sr.
2,552,076 A 5/1951 Wedge
2,612,169 A 9/1952 Segal
2,789,561 A 4/1957 Bonn et al.
2,865,377 A 12/1958 Schroer et al.
2,871,711 A 2/1959 Stark
2,891,553 A 6/1959 Acton
2,894,513 A 7/1959 Gempe et al.
2,950,719 A 3/1962 Lyon
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider et al.
3,205,894 A 9/1965 Rankin
3,205,895 A 9/1965 Johnson
3,255,759 A 6/1966 Dennis
3,348,550 A 10/1967 Wolf et al.
3,718,402 A 2/1973 Schade
3,748,051 A 7/1973 Frank
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,222,679 A 9/1980 Luogameno
4,352,582 A 10/1982 Eliasson
4,486,112 A 12/1984 Cummins
4,522,526 A 6/1985 Lozfau et al.
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence et al.
4,919,557 A 4/1990 Podosek
5,067,840 A 11/1991 Cooper et al.
5,116,157 A 5/1992 Gillum et al.
5,135,323 A 8/1992 Pinheiro
5,180,247 A 1/1993 Yu
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,524,997 A 6/1996 von Rohrscheidt
5,577,852 A 11/1996 To
5,651,628 A 7/1997 Bankes et al.
5,660,490 A 8/1997 Warrington
5,692,847 A 12/1997 Zane et al.
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,895,164 A 4/1999 Wu
5,924,811 A 7/1999 To et al.
5,957,611 A 9/1999 Whaley
5,975,785 A 11/1999 Chan
6,036,394 A 3/2000 Cheng
6,142,697 A 11/2000 Williams
6,146,042 A 11/2000 To et al.
6,155,737 A 12/2000 Whaley
6,203,229 B1 3/2001 Coerver
6,206,601 B1 3/2001 Ko
6,217,247 B1 4/2001 Ng
6,270,279 B1 8/2001 Whaley
6,276,862 B1 * 8/2001 Snyder ..... B42F 13/26 402/26
6,293,722 B1 9/2001 Holbrook et al.
6,364,558 B1 4/2002 To
6,371,678 B1 4/2002 Chizmar
6,467,984 B1 10/2002 To
6,474,897 B1 11/2002 To
6,533,486 B1 3/2003 To
6,749,357 B2 6/2004 Cheng
6,758,621 B2 7/2004 To
6,821,045 B2 11/2004 Whaley
6,840,695 B2 1/2005 Horn
6,916,134 B2 7/2005 Wong
7,223,040 B2 5/2007 Koike et al.
7,275,886 B2 10/2007 Cheng
7,296,946 B2 11/2007 Cheng et al.
7,404,685 B2 7/2008 Cheng
7,478,963 B2 1/2009 Tanaka et al.
7,491,006 B2 2/2009 Whaley
7,524,127 B2 4/2009 Petrie et al.
7,524,128 B2 4/2009 Cheng
7,530,755 B2 5/2009 Whaley
7,534,064 B2 5/2009 Cheng
7,549,817 B2 6/2009 Cheng et al.
7,648,302 B2 1/2010 Zhang et al.
7,661,898 B2 2/2010 Ng et al.

(56) References Cited

U.S. PATENT DOCUMENTS

| | | | | |
|---|---|---|---|---|
| 7,661,899 | B2 * | 2/2010 | Lin | B42F 13/26 402/19 |
| 7,665,926 | B2 | 2/2010 | Cheng | |
| 7,674,062 | B2 | 3/2010 | Horn | |
| 7,726,897 | B2 | 6/2010 | To et al. | |
| 7,731,441 | B2 | 6/2010 | Ng et al. | |
| 7,748,922 | B2 | 7/2010 | Cheg | |
| 8,186,899 | B2 | 5/2012 | Ng et al. | |
| 8,517,624 | B2 * | 8/2013 | Warmus | B42F 13/26 402/30 |
| 9,102,187 | B1 * | 8/2015 | Zhong | B42F 13/22 |
| 2003/0044221 | A1 | 3/2003 | To et al. | |
| 2005/0013654 | A1 * | 1/2005 | Cheng | B42F 13/26 402/36 |
| 2005/0201818 | A1 | 9/2005 | Cheng | |
| 2005/0207826 | A1 | 9/2005 | Cheng et al. | |
| 2006/0008318 | A1 | 1/2006 | Ng | |
| 2006/0056906 | A1 | 3/2006 | Horn | |
| 2006/0147254 | A1 | 7/2006 | Cheng | |
| 2006/0251467 | A1 | 11/2006 | Cheng | |
| 2007/0086836 | A1 | 4/2007 | Cheng | |
| 2007/0140780 | A1 | 6/2007 | Petrie et al. | |
| 2008/0075526 | A1 * | 3/2008 | Ng | B42F 13/26 402/29 |
| 2008/0075527 | A1 | 3/2008 | Pi et al. | |
| 2009/0035053 | A1 | 2/2009 | Pi et al. | |
| 2009/0060631 | A1 | 3/2009 | To et al. | |
| 2009/0110469 | A1 | 4/2009 | To et al. | |
| 2011/0170942 | A1 | 7/2011 | Huang et al. | |
| 2013/0287476 | A1 | 10/2013 | Huang | |
| 2014/0186094 | A1 | 7/2014 | Lin | |

FOREIGN PATENT DOCUMENTS

| | | | | | |
|---|---|---|---|---|---|
| FR | 1336765 | A | | 9/1963 | |
| FR | 1346864 | A | | 12/1963 | |
| FR | 2221924 | | | 10/1974 | |
| FR | 2238332 | A5 | | 2/1975 | |
| GB | 837875 | | | 6/1960 | |
| GB | 868724 | | | 5/1961 | |
| GB | 906279 | | | 9/1962 | |
| GB | 952536 | | | 3/1964 | |
| GB | 2275023 | A | | 8/1994 | |
| GB | 2292343 | A | | 2/1996 | |
| GB | 2387815 | A | | 10/2003 | |
| JP | 5979379 | U | | 5/1984 | |
| JP | 6118880 | U | | 2/1986 | |
| JP | 1299095 | A | | 12/1989 | |
| JP | 2034289 | U | | 3/1990 | |
| JP | 4120085 | U | | 10/1992 | |
| JP | 8009274 | B | * | 1/1996 | |
| JP | GB 2292343 | A | * | 2/1996 | B42F 13/22 |
| JP | 10-217662 | A | | 8/1998 | |
| JP | 2004098417 | A | | 4/2004 | |
| WO | 2013026351 | A1 | | 3/2009 | |

* cited by examiner

RING BINDER MECHANISM

FIELD OF INVENTION

This invention relates generally to a ring binder mechanism for retaining loose-leaf pages, and in particular to a ring binder mechanism having a locking system that automatically locks the rings in the closed position.

BACKGROUND OF THE INVENTION

Ring binder mechanisms retain loose-leaf pages on rings. Ring binder mechanisms can be used in notebooks, files, briefcases, clipboards and other similar objects to give the object a loose-leaf page retaining function. A conventional ring binder mechanism has rings formed by ring members that are selectively moveable to open the rings to add and/or remove loose leaf pages and close the rings to retain loose-leaf pages on the rings. The ring members are commonly mounted on adjoining hinge plates supported by a housing for pivoting movement between open and closed positions. The undeformed housing is slightly narrower than the combined width of the hinge plates such that the housing applies a spring force that biases the ring members against movement toward the open position when they are in the closed position. If this spring force is strong, there is a risk that a user could be injured by getting a finger pinched between the ring members as the housing causes them to snap shut during closing. Thus, it is desirable to design the housing so it exerts a relatively light spring force on the ring members to reduce the risk of injury to users.

However, the absence of a strong biasing force holding the ring members in the closed position increases the risk that the rings will inadvertently open (e.g., if the ring mechanism is accidentally dropped) and fail to retain loose-leaf pages. One way to reduce the risk the rings will inadvertently open is to provide a locking system that blocks pivoting movement of the ring members from the closed position to the open position. It is desirable for the locking system to automatically lock the rings closed when the rings are moved to the closed position. It is also desirable to be able to unlock and open the rings in a single step to make the ring mechanism convenient to use.

One problem that can sometimes occur with ring mechanism having a locking mechanism is that sometimes the locking mechanism might not fully engage even when the rings are closed. Ring mechanisms that allow closing and locking with a single motion sometimes require users to follow through farther on a closing action to ensure locking is complete than is required to close the rings. This leads to the possibility that a user thinks a ring mechanism is closed and locked when it is merely closed and remains unlocked. Another complication is that some ring mechanism allow a user to close the rings either by using an actuator (often referred to as a booster) to close the rings or by moving the ring members to the closed position without any manipulation of the actuator. When a ring mechanism having an automatic locking mechanism provides the user the option to close the rings in one of two different ways, it is sometimes the case that one of the ways is not as effective at locking the rings as the other. In particular, it is common for a locking mechanism to fail to engage fully after a user closes the rings by direct movement of the ring members without any manipulation of the actuator.

SUMMARY

One aspect of the invention is a ring binder mechanism for retaining loose leaf pages. The mechanism includes an elongate housing. First and second hinge plates are supported by the housing for pivoting motion relative to the housing. The mechanism has rings for holding the loose-leaf pages. Each ring includes a first ring member and a second ring member. The first ring member is moveable with the pivoting motion of the first hinge plate relative to the second ring member between a closed position and an open position. In the closed position, the two ring members form a substantially continuous, closed loop for allowing loose-leaf pages retained by the rings to be moved along the rings from one ring member to the other. In the open position the two ring members form a discontinuous, open loop for adding or removing loose-leaf pages from the rings. An actuator is mounted for movement relative to the housing between open and closed positions of the actuator. The actuator has an opening arm and a closing arm. The hinge plates extend into a notch in the actuator between the opening arm and closing arm so the opening and closing arms can be forced against lower and upper surfaces of the hinge plates, respectively, to pivot the hinge plates by pivoting the actuator. The mechanism has an elongate travel bar operatively connected to the actuator for movement of the travel bar longitudinally in the housing by rotation of the actuator from its closed position to its open position. The travel bar has a plurality of locking elements and a cam. The locking elements are positioned to block pivoting movement of the hinge plates when the actuator and rings are in the closed position and the locking elements are in a locking position. The cam extends into an opening in the hinge plates and has an camming surface at an edge of said opening when the rings and actuator are in their closed positions. The housing exerting a spring force on the hinge plates that resists movement of the hinge plates toward the open position when the hinge plates are in the closed position and resists movement of the hinge places toward the closed position when the hinge plates are in the open position. Movement of the actuator from the closed position to the open position causes the opening arm to push upwardly against a lower surface of at least one of the hinge plates and causes the camming surface of the cam to push upwardly on at least one of the hinge plates so the opening arm on the actuator and the camming surface of the cam cooperatively drive pivoting movement of the hinge plates from their closed position against the spring force of the housing to open the rings.

Another aspect of the invention is a ring binder mechanism for retaining loose leaf pages. The mechanism has an elongate housing. First and second hinge plates are supported by the housing for pivoting motion relative to the housing. The mechanism has rings for holding the loose-leaf pages. Each ring includes a first ring member and a second ring member. The first ring member is moveable with the pivoting motion of the first hinge plate relative to the second ring member between a closed position and an open position. In the closed position the two ring members forming a substantially continuous, closed loop for allowing loose-leaf pages retained by the rings to be moved along the rings from one ring member to the other. In the open position the two ring members forming a discontinuous, open loop for adding or removing loose-leaf pages from the rings. An actuator is mounted for movement relative to the housing between open and closed positions of the actuator. The actuator has an opening arm and a closing arm, the hinge plates extend into a notch in the actuator between the opening arm and closing arm so the opening and closing arms can be forced against lower and upper surfaces of the hinge plates, respectively, to pivot the hinge plates by pivoting the actuator. An elongate travel bar is operatively connected to the actuator for movement of the travel bar longitudinally in the housing by pivoting the actuator. The travel bar has a plurality of locking elements and a cam. The locking elements are positioned to block pivoting movement of the hinge plates when the actuator and rings are in the closed position and the locking elements are in locked position. The cam extends into an opening in the hinge plates and has an camming surface at an edge of said opening when the rings and actuator are in their open positions. The housing exerts a spring force on the hinge plates that resists movement of the hinge plates toward the open position when the hinge plates are in the closed position and resists movement of the hinge places toward the closed position when the hinge plates are in the open position. The cam and hinge plates are arranged so at least one of the hinge plates contacts the camming surface as the hinge plates pivot from the open position to the closed position and exerts a force on the travel bar tending to move the travel bar and locking elements into the locked position.

Other objects and features will in part be apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
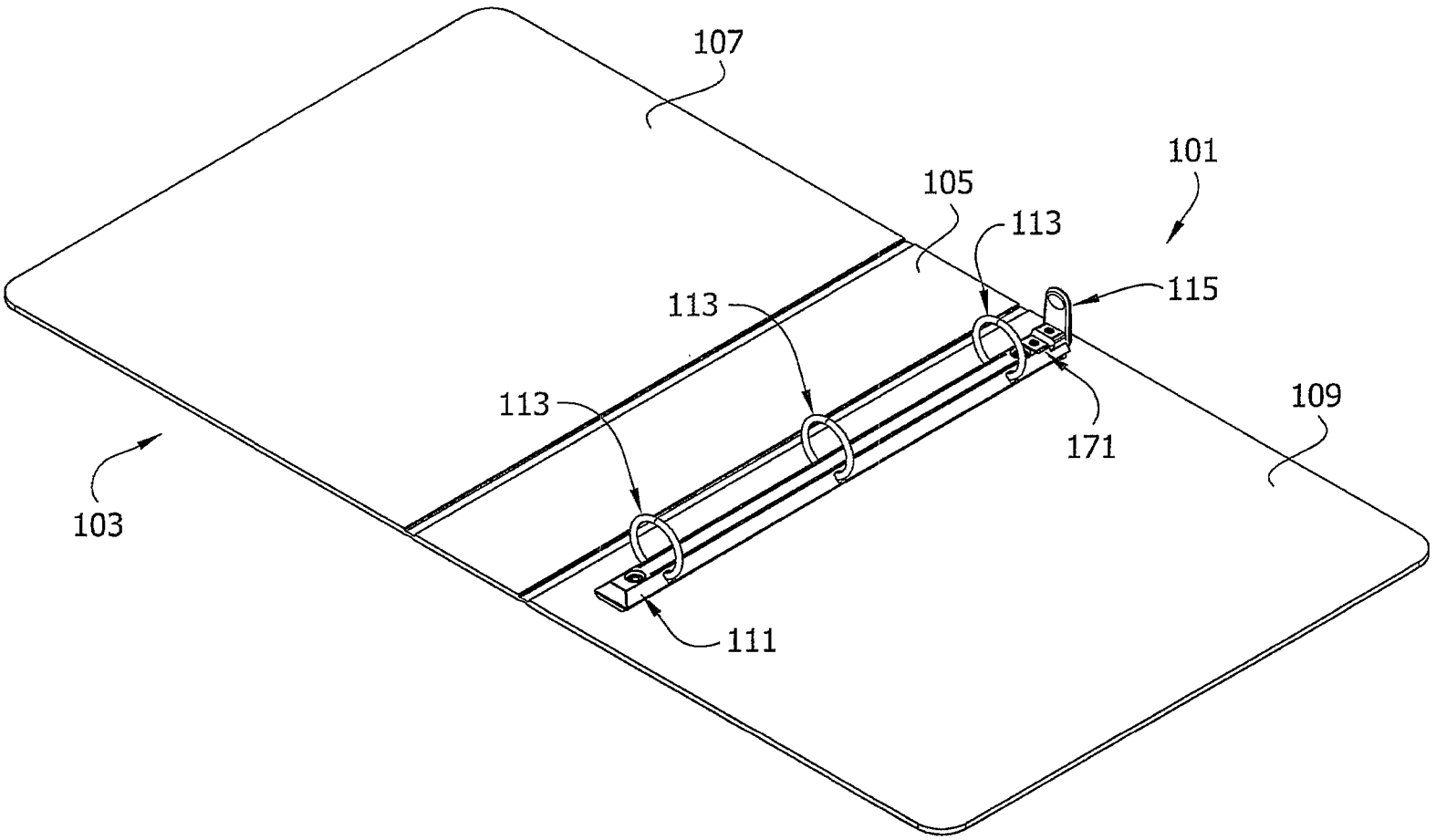
FIG. 1 is a perspective of a notebook and one embodiment of a ring binder mechanism secured to the notebook.
Figure 2:
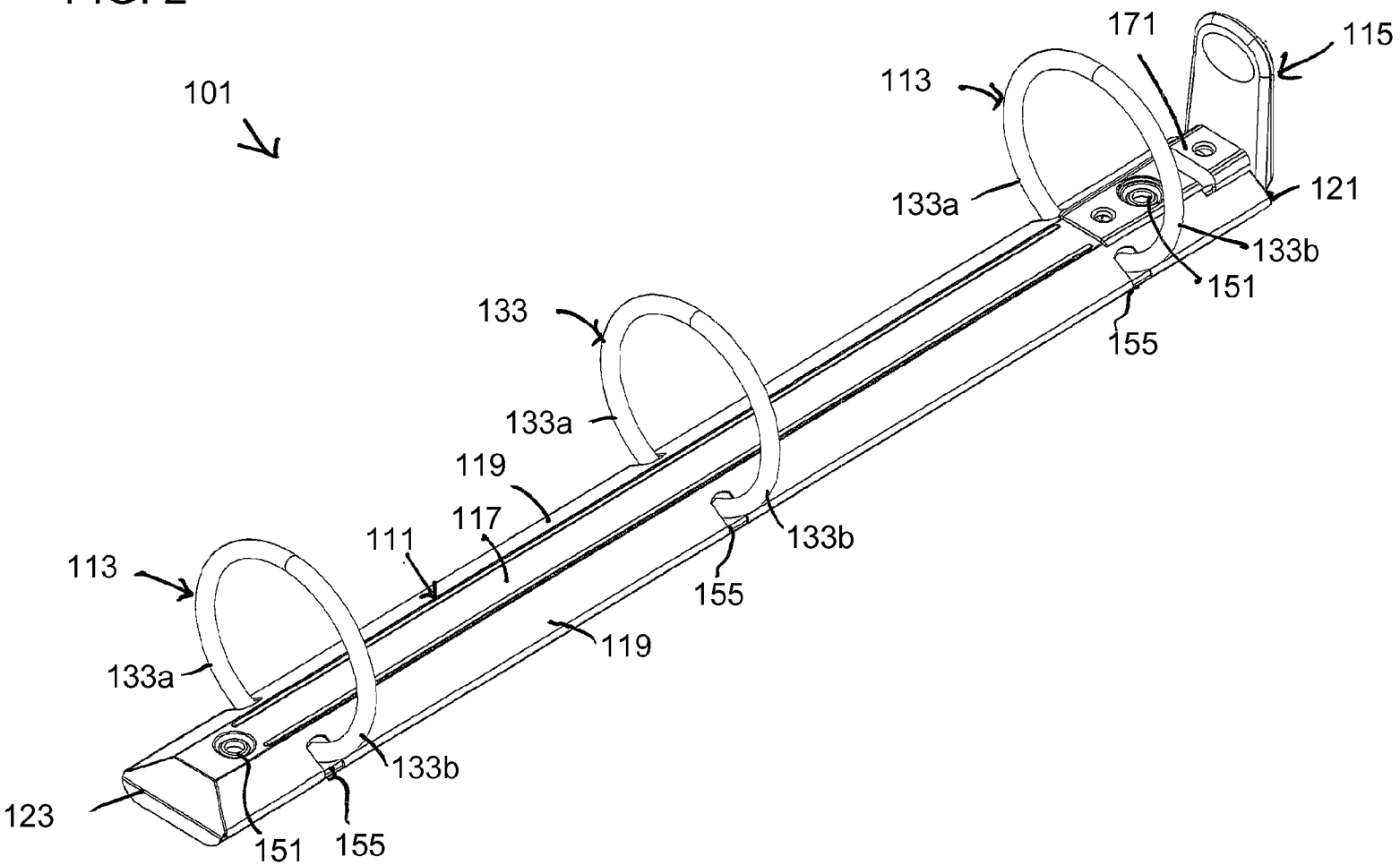
FIG. 2 is a perspective of the ring binder mechanism in a closed position.

Referring to the drawings, FIGS. 1-13 show an embodiment of a ring binder mechanism of the present invention, generally indicated at 101. In FIG. 1, the mechanism 101 is mounted on a notebook cover 103. Specifically, the mechanism 101 is mounted adjacent the spine 105 of the notebook cover 103. The spine 105 extends between front and back covers 107, 109 that are hingedly attached to the spine 105. The front and back covers 107, 109 are moveable to selectively cover or expose loose-leaf pages (not shown) retained by the mechanism 101. Ring binder mechanisms mounted on a notebook cover in other ways (e.g., on the spine) or on substrates other than a notebook cover (e.g., a file, a briefcase, etc.) do not depart from the scope of this invention.

As shown in FIGS. 2-6, the mechanism 101 includes an elongate housing 111 supporting a plurality of rings (each of which is designated generally 113). The housing 111 also has a raised flat central plateau 117 and sides 119 extending down and laterally outward from opposite sides of the plateau. The sides 119 of the housing are substantially parallel to one another. The plateau 117 and sides 119 give the housing a roughly arch-shaped cross-sectional shape. The flatness of the plateau 117 and sides 119 make the arch-shaped cross-sectional shape of the housing 111 segmented and angular arch shape. However, it is understood that the sides and central top portion of the housing can be more smoothly curved within the scope of the invention. In the illustrated embodiment, a first longitudinal end 121 of the housing 111 is generally open while a second, opposite longitudinal end 123 is generally closed. Bent under rims 125 extend lengthwise along the outer edge margins of the sides 119 of the housing 111. Mechanisms having housings shaped differently than the housing 111 illustrated in the drawings are within the scope of the invention.

The rings 113 are operable to retain loose-leaf pages on the ring mechanism 101 in the notebook 103. The ring mechanism 101 illustrated in the drawings has three rings 113. However, the number of rings can vary within the scope of the invention. The rings 113 shown in the drawings are substantially identical to one another and are each generally circular in shape. As shown in FIGS. 1-6, the rings 113 each include two ring members 133 (sometimes referred to and designated 133*a* and 133*b* to refer to a particular one of the ring members in a pair). The ring members 133 are suitably formed from a conventional, cylindrical rod of a suitable material (e.g., steel) having a circular cross-sectional shape. Ring binder mechanisms with ring members formed of different material or having different cross-sectional shapes (e.g., oval cross-sectional shapes) do not depart from the scope of this invention. The ring members 133 in the illustrated embodiment are generally semi-circular so the rings 113 have a generally circular shape, but the rings can have non-circular shapes within the scope of the invention. Further, one of the ring members can have a different shape from the other, such as is the case with D-shaped rings and other asymmetric rings.

Figure 4:
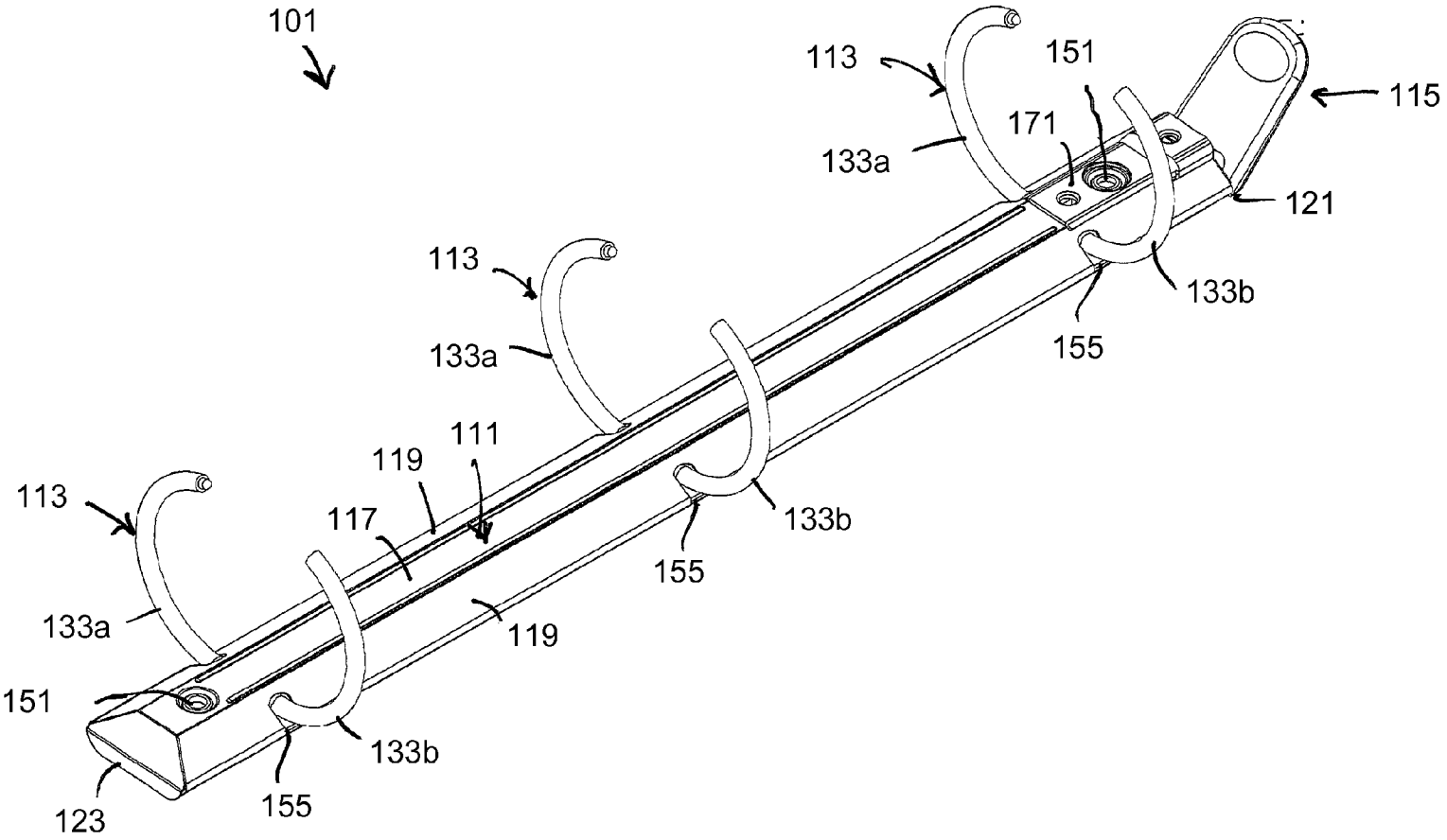
FIG. 4 is a perspective of the ring binder mechanism similar to FIG. 2 but showing the mechanism in an open position.

At least one of the ring members 133*a* of each ring 113 is moveable relative to the housing 111 and the opposing ring member 133*b* between a closed position (FIG. 2) and an open position (FIG. 4). In the ring mechanism 101 shown in the drawings, the two ring members 133*a*, 133*b* each move in a substantially similar way relative to housing 111 to open and close the rings 113, but this is not necessary to practice the invention. For example, one of the ring members of each ring could be fixed to the housing within the scope of the invention. In the closed position (FIG. 2) the ring members 133 form a substantially continuous, closed loop for allowing loose-leaf pages retained by the rings 113 to be moved along the rings from one ring member to the other. In the open position (FIG. 4) the ring members 133 form a discontinuous, open loop for adding or removing loose-leaf pages from the rings 113.

Figure 3:
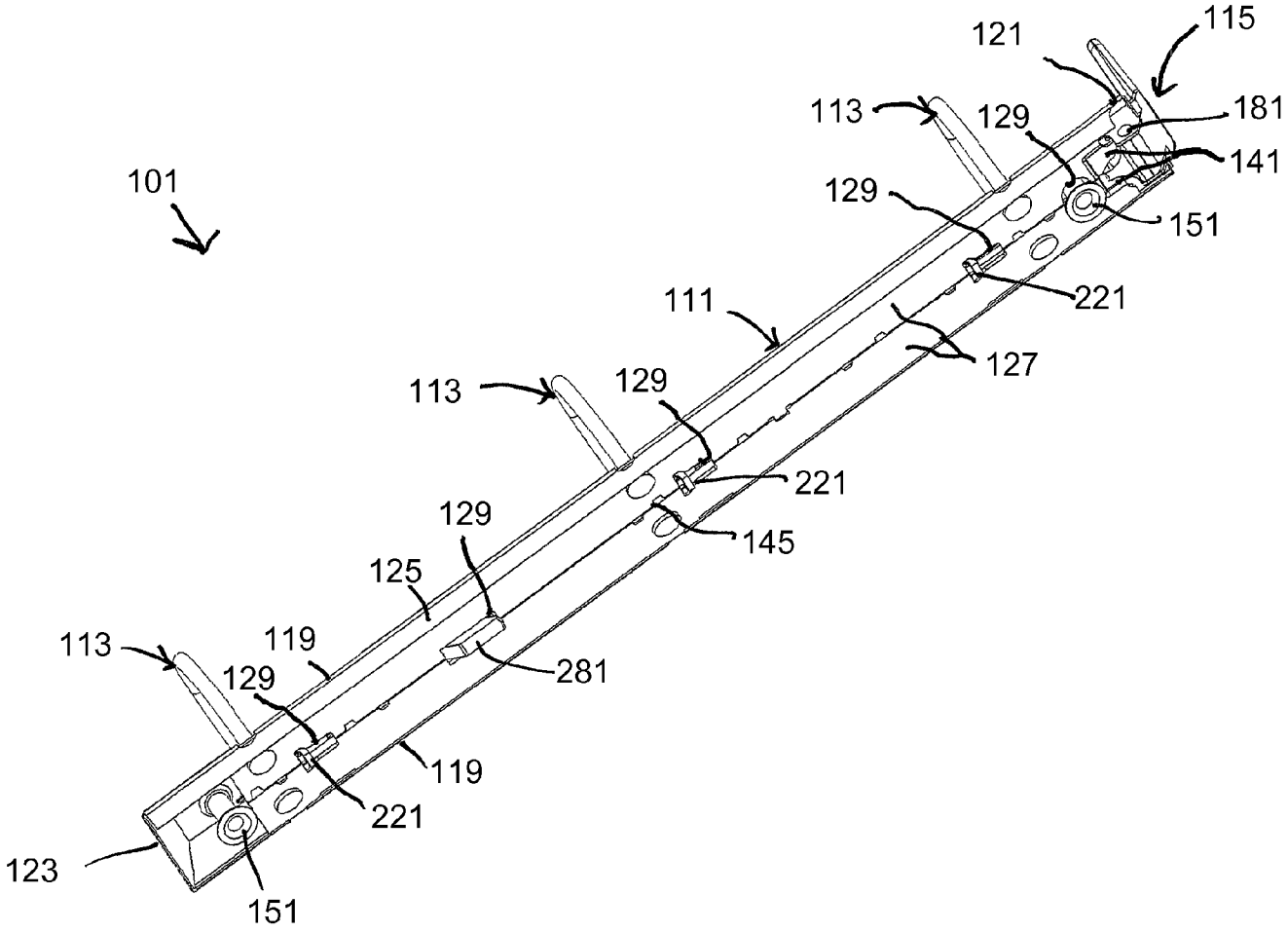
FIG. 3 is another perspective of the ring binder mechanism in the closed position taken from a different vantage point.
Figure 5:
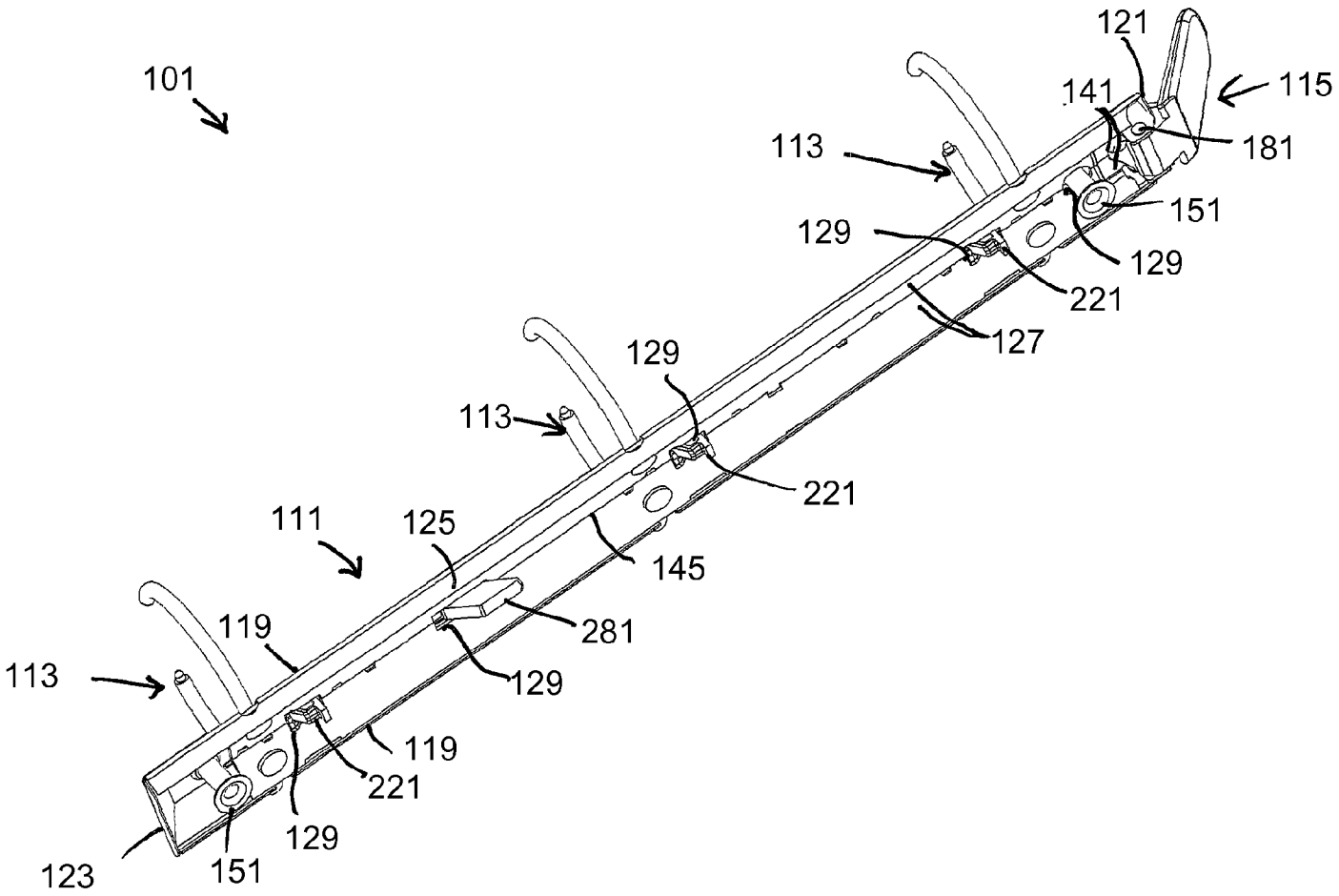
FIG. 5 is perspective of the ring binder mechanism similar to FIG. 3 but showing the mechanism in the open position.
Figure 6:
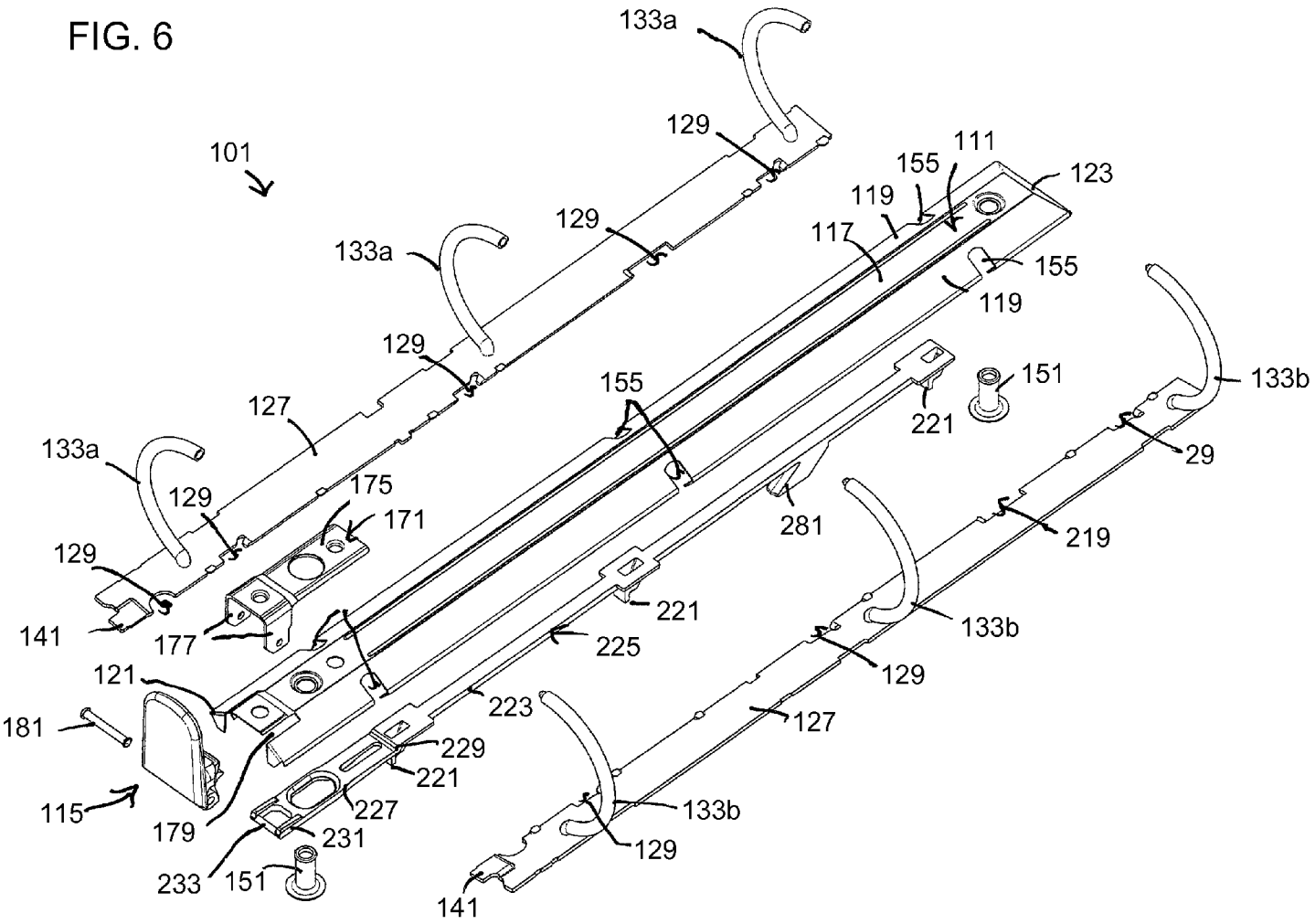
FIG. 6 is an exploded perspective of the ring binder mechanism.

The ring mechanism 101 includes two substantially identical hinge plates 127 supporting the ring members 133. The hinge plates 127 are each generally elongate, flat, and rectangular in shape and are each somewhat shorter in length than the housing 111. The hinge plates 127 are interconnected in parallel arrangement along their inner longitudinal edge margins (as illustrated in FIGS. 3 and 5), forming a central hinge 145 having a pivot axis. This is suitably done in a conventional manner known in the art. The outer longitudinal edge margins of the hinge plates 127 are received in the grooves formed by the bent under rims 125 of the housing 111, which thereby supports the hinge plates for pivoting within the housing. As shown in FIG. 6, the ring members 133*a*, 133*b* are each mounted in generally opposed fashion on respective ones of the hinge plates 127. The ring members 133 extend through respective openings 155 along the sides 119 of the housing 111 so that the free ends of the ring members engage one another above the housing when the rings 113 are closed. The ring members 133 are rigidly connected to the hinge plates 127 and move with the hinge plates when they pivot. In the ring binder mechanism 101 illustrated in the drawings, both ring members 133 of each ring 113 are mounted so they extend from the upper surfaces of the hinge plates 127. However, a mechanism in which one or more ring members are mounted so they extend from a lower surface of the hinge plate (e.g., as disclosed in commonly owned U.S. Pub. Pat. App. No. 20080008519) is also within the scope of the invention.

The hinge plates 127 can be pivoted downward and upward on the central hinge 145 relative to the housing 111 to move the ring members 133 mounted thereon between the closed position and the open position. The ring members 133 close when the hinge plates 127 pivot downward (i.e., the central hinge 145 moves away from the housing 111). The ring members 133 open when the hinge plates 127 pivot upward (i.e., the central hinge axis 145 moves toward the housing 111). The combined width of the hinge plates 127 is wider than the spacing between the bent under rims 125 of the housing 111 when the hinge plates are in a co-planar position. Consequently, as the hinge plates 127 pivot through the co-planar position, the hinge plates deform the housing 111 and create a spring force in the housing. The housing spring force biases the hinge plates 127 and rings 113 to remain closed when they are in the closed position and biases the hinge plates and rings to remain open when they are in the open position.

An actuator 115 is moveable relative to the housing 111 by a user to cause the pivoting motion of the hinge plates 127 against the spring force from the housing 111 to open and close the rings 113. The actuator 115 is rotatable between a first position (FIGS. 9 and 10) in which the ring members 133 are in the closed position and a second position (FIG. 11) in which the ring members are in the open position.

In the illustrated embodiment, the actuator 115 is mounted for pivoting movement relative to the housing between the open and closed positions on a lever mount 171 (FIG. 6) formed separately from the housing 111 and secured to the housing (e.g., by one or more rivets or other suitable fasteners). The lever mount 171 includes a plate 175 positioned on top of the housing plateau 117 at the open end 121 of the housing 111. The lever mount 171 also has arms 177 extending from opposite sides of the plate 175 into the housing 111 through slots 179 at the end 121 of the housing. The actuator 115 is pivotally connected to the lever mount by a pivot pin 181 extending through the actuator and retained by the arms of the lever mount. Thus, the actuator 115 is pivotal about a pivot axis coincident with the pin 181. The lever mount 171 does not extend longitudinally beyond the open end 121 of the housing 111. Also, only a relatively minor portion of the actuator 115 extends longitudinally beyond the open end 121 of the housing 111 when the rings are closed. Other ways of mounting the actuator, including directly to the housing without a separate lever mount, do not depart from the scope of the invention.

Figure 8:
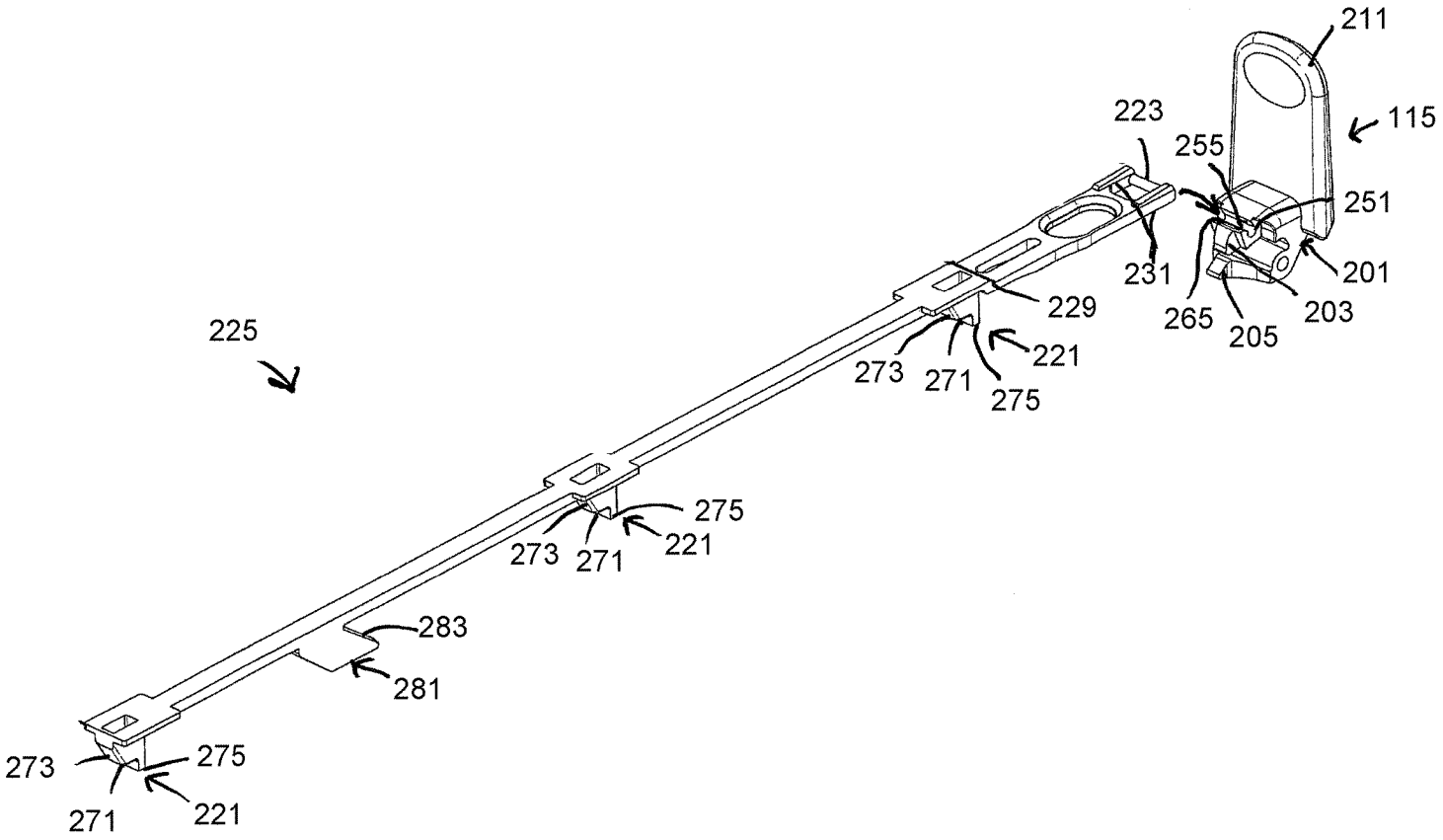
FIG. 8 is a perspective of the travel bar being connected to one embodiment of an actuator.
Figure 9:
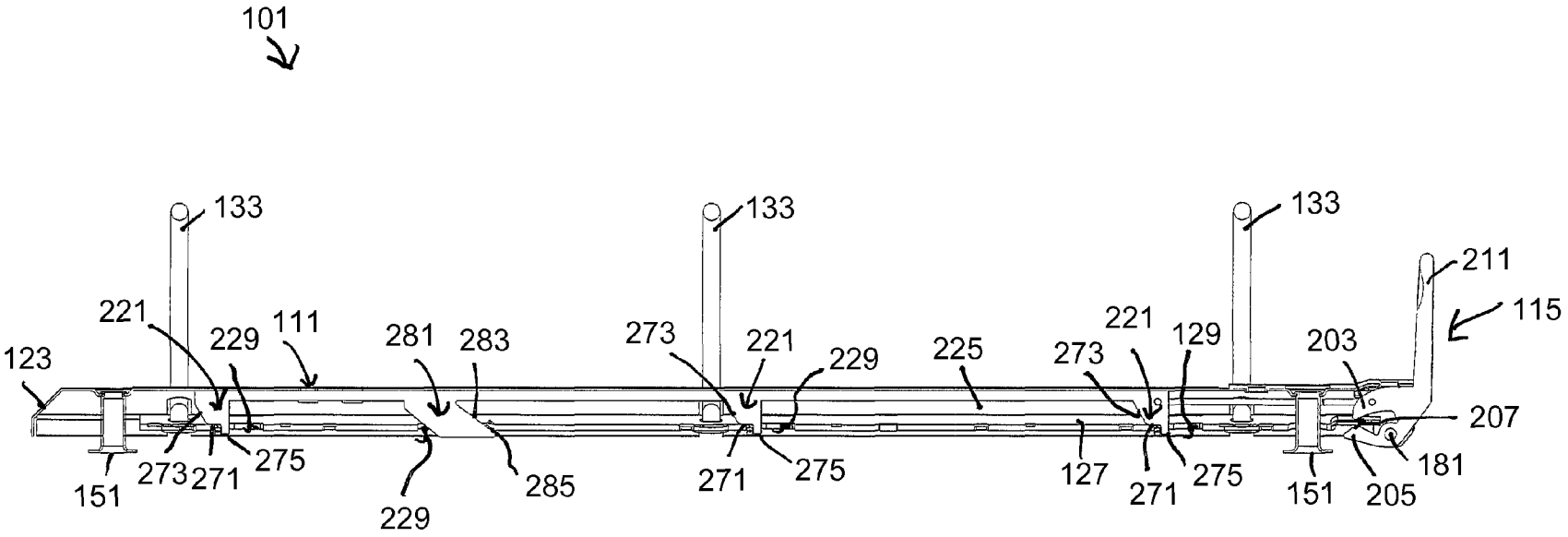
FIG. 9 is a side elevation of the ring binder mechanism illustrated in longitudinal cross section with the rings closed.
Figure 10:
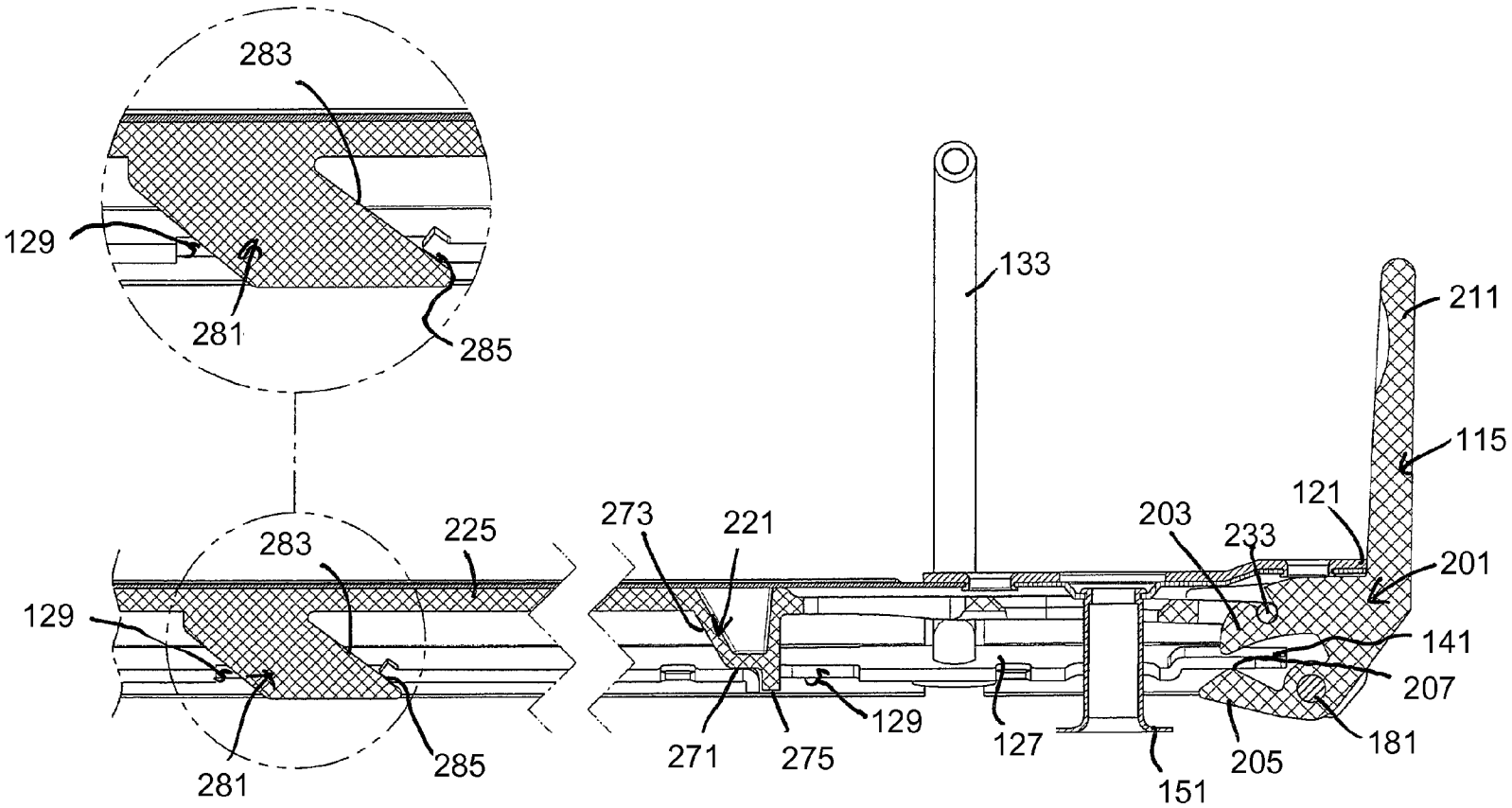
FIG. 10 is an enlarged fragmentary view of the ring mechanism as illustrated in FIG. 9.
Figure 11:
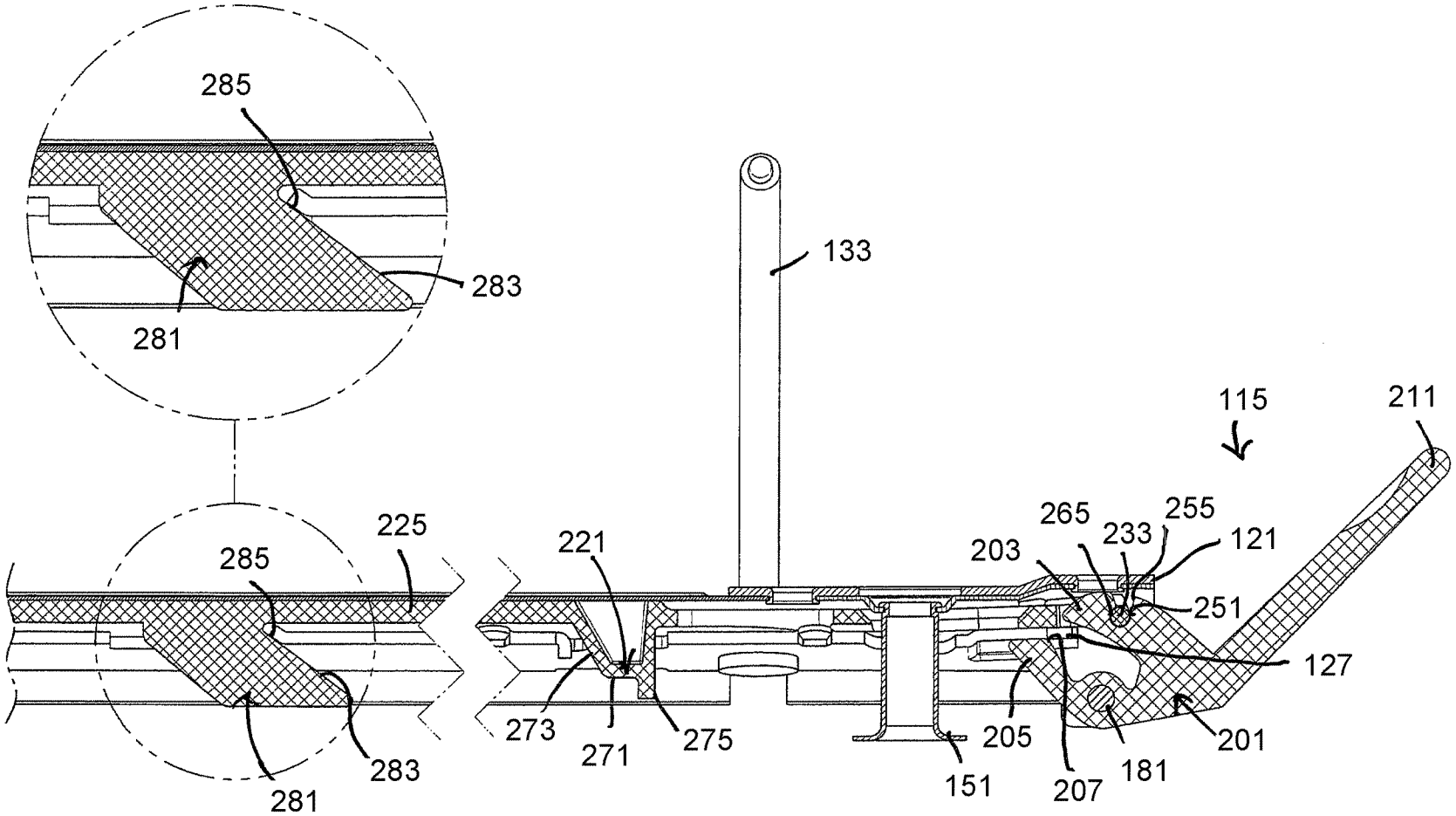
FIG. 11 is an enlarged fragmentary view of the ring mechanism similar to FIG. 10 except that the rings are open.

Referring now to FIGS. 8-11, the actuator 115 has a body 201 and a closing arm 203 extending from the body. The closing arm 203 is positioned to pivot the hinge plates 127 and move the rings 113 to the closed position when the actuator is moved from the open position to the closed position. The actuator 115 also has an opening arm 205 extending from the body 201 and positioned to pivot the hinge plates 127 and move the rings 113 to the open position when the actuator is moved from the closed position to the open position. As seen in FIGS. 10 and 11, the closing and opening arms 203, 205 form a channel 207 in which the ends of the hinge plates 127 are received. A handle 211 extends from the body 201 of the actuator 115 to facilitate movement of the actuator by a user between the open and closed position. The handle of the actuator can have many different shapes within the scope of the invention.

The ends of the hinge plates 127 are received in the channel 207 so the closing arm 203 is above the ends of the hinge plates and the opening arm 205 is below the ends of the hinge plates. Each of the hinge plates 127 has a relatively narrow finger 141 (FIG. 6) extending longitudinally toward the open end 121 of the housing 111. The fingers 141 are each narrower in width than the respective hinge plates 127 and are positioned so their inner longitudinal edges are generally aligned with the inner longitudinal edges and central hinge 145 of the hinge plates. When the actuator 115 is moved from the closed position to the open position, the opening arm 205 applies an upward force to the fingers 141 of the hinge plates, which pivots the central hinge 145 upward to open the rings 113. Likewise, when the actuator is moved from the open position to the closed position, the closing arm 203 applies a downward force to the fingers 141, which pivots the central hinge 145 downward to close the rings 113.

In addition to opening and closing the rings 113 as described above, the actuator 115 is also adapted to move a locking element 221 between a locking position (FIG. 10) a non-locking position (FIG. 11) as the actuator is moved between its open and closed positions to open and close the rings 113. In the locking position, the locking element 221 prevents movement of the rings 113 from the closed position to the open position by blocking the pivoting motion of the hinge plates 127. In the non-locking position, the locking element 221 does not block movement of the hinge plates 127 and rings 113 from the closed position to the open position.

Figure 7:
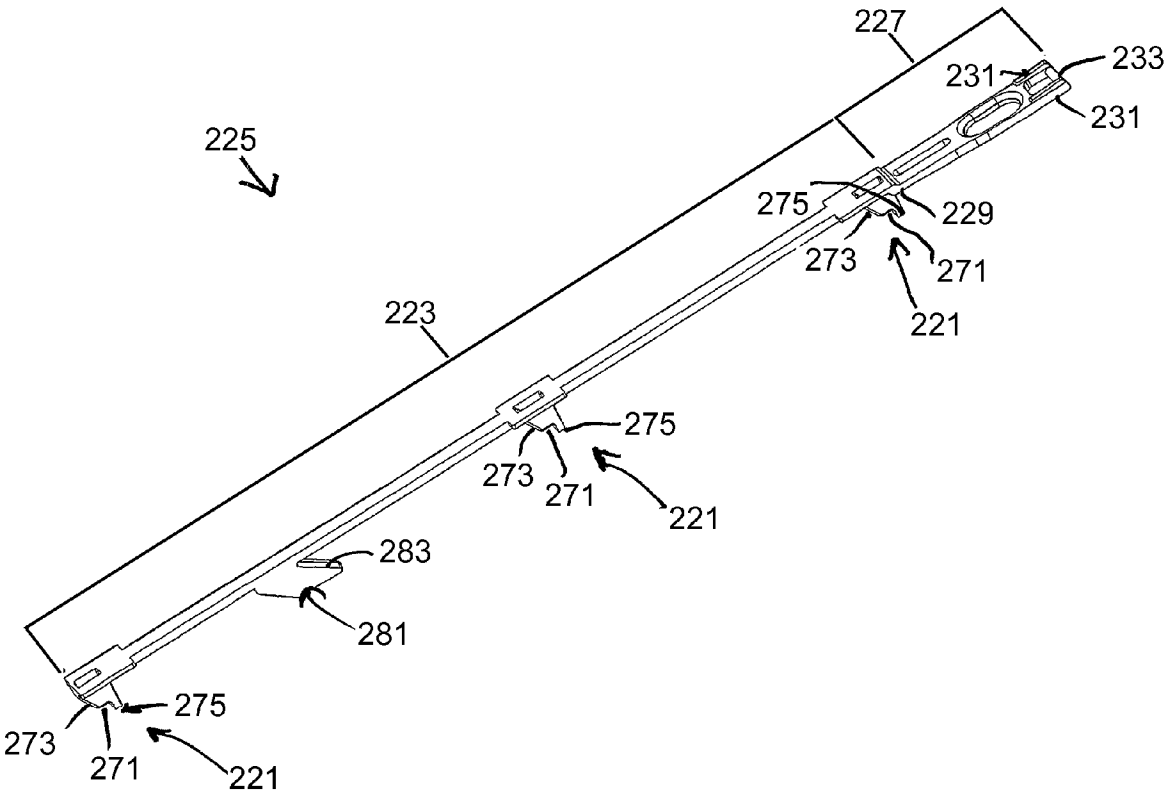
FIG. 7 is a perspective of one embodiment of a travel bar of the ring binder mechanism.

As illustrated in FIGS. 7 and 8, the locking element 221 is one of three substantially identical locking elements (each of which is designated 221) on a locking portion 223 of a travel bar 225, which extends longitudinally in the housing 111 between the hinge plates 127 and the plateau 117 of the housing. The number of locking elements can vary without departing from the scope of the invention. The locking elements 221 are spaced apart longitudinally along the locking portion 223 of the travel bar 225 with one locking element adjacent each longitudinal end of the locking portion 223 of the travel bar, and one located toward a center of the locking portion of the travel bar. The locking elements 221 protrude from the locking portion 223 of the travel bar 225 toward the hinge plates 127. As shown in FIGS. 7-11, each locking element 221 includes a flat bottom 271, an angled forward edge 273, and a rearward extension 275. The angled edges 273 of the locking elements 221 may engage the hinge plates 127 and assist in pivoting the central hinge 145 of hinge plates down during closing. In the illustrated embodiment, the locking elements 221 are formed integrally as one piece of material with the travel bar 225 by, for example, an injection molding process. But the locking elements may be formed separately from the travel bar and attached thereto without departing from the scope of the invention. Additionally, locking elements with different shapes, for example, block shapes (e.g., no angled edges), are within the scope of this invention. The travel bar 225 and locking elements 221 may be broadly referred to as a "locking system."

Cutouts 129 (FIGS. 3 and 6) are formed in each of the hinge plates 127 along an inner edge margin of the plate. The cutouts 129 in each of the individual hinge plates 127 align to form five openings (also designated 129) along the central hinge 145 of the interconnected hinge plates, as best illustrated in FIG. 3. A mounting post 151 passes through one of the openings 129 in the hinge plates 127 proximal to the open end 121 of the housing 111. Three of the other openings 129 are positioned axially along the central hinge axis 145 of the hinge plates 127 in proximity to the locking elements 221. In particular, the openings 129 are positioned so they are in registration with the locking elements 221 when the travel bar 225 is in the non-locking position (FIGS. 5 and 11) and so they are out of registration with the locking elements when the travel bar is in the locking position (FIGS. 3, 9, and 10). As illustrated in FIGS. 9 and 10, when the travel bar 225 is in the locking position, the flat bottoms 271 of the locking elements 221 engage the upper surfaces of the hinge plates 127 at the edges of the openings 129 and thereby block pivoting movement of the hinge plates toward their open position. As illustrated, although portions of the travel bar 225, including the locking elements 221, may extend through the openings 129 in the hinge plates 127, the travel bar extends longitudinally along the space between the hinge plates 127 and the housing 111 continuously between opposite longitudinal ends of the travel bar.

An intermediate connector portion 227 of the travel bar 225 (FIGS. 6 and 7) connects the locking portion 223 of the travel bar to the actuator 115. The intermediate connector 227 of the travel bar 225 is suitably attached to the locking portion 223 by a hinge 229 (e.g., a living hinge) that allows pivoting movement of the connector portion relative to the locking portion to facilitate conversion of the motion of the connector portion, which can be driven by the actuator 115 in a manner than includes some rotation, to linear movement of the locking portion of the travel bar. The hinge 229 suitably has greater flexibility than the connector portion 227 of the travel bar 225, for example due to construction of the hinge as a segment of the travel bar that has a reduced thickness compared to the connector portion 227. It is recognized that a hinge connection between the locking portion and connecting portion of the travel bar is not required within the broad scope of the invention.

Referring to FIGS. 6, 10, and 11, the end of the connector portion 227 of the travel bar 225 opposite the hinge 229 is at the open end 121 of the housing. The end of the connector portion 227 has arms 231 extending longitudinally of the housing 111 toward the open end 121 and a cross bar 233 at the end of the travel bar 225 and extending between the arms. The cross bar 233 is captured by the actuator 115 so movement of the actuator between the open and closed positions produces movement of the cross bar 233 at the end of the travel bar 225.

Referring to FIG. 8, there is a slot or recess 255 in which the cross bar 233 at the end of the travel bar 225 can be captured. In the illustrated embodiment, the recess 255 is between the closing arm 203 and the handle 211. When the cross bar 233 of the travel bar 225 is captured in the recess 255 by the actuator 115, the cross bar extends through the recess from one side of the actuator to the opposite side of the actuator. A portion of the recess 255 is defined by a concave surface 265 shaped to generally conform to the shape of the cross bar 233 to facilitate seating of the cross bar against the concave surface during opening. Another portion of the recess is defined by a concave surface 251 shaped to generally conform to the shape of the cross bar 233 to facilitate seating of the cross bar against the surface during closing.

The travel bar 225 and actuator 115 are adapted so the cross bar 233 can be snapped into the recess 255 during assembly of the ring mechanism 101 by moving the cross bar relative to the actuator in a direction (e.g., generally downward, as indicated by the arrow in FIG. 8) that is generally perpendicular to the longitudinal axis of the cross bar. This can be advantageous because it facilitates use of a travel bar 225 in which the cross bar 233 is formed integrally as one piece with the rest of the connector portion 227. It can also be advantageous because there is no need for precise alignment and insertion of various components into other components, as would be the case if assembly of the travel bar and actuator required a pin or other elongate structure to be inserted longitudinally into an opening that is about the same size as the structure to be inserted therein. This simplifies assembly of the ring mechanism 101.

It is envisioned that the entire actuator 115 (except for an optional cushion, not shown, that may cover some or all of the handle 211) is formed integrally as one piece (e.g., from a resilient moldable polymeric material). However, the actuator 115 may be formed from other materials or by other processes within the scope of this invention. For example, an actuator made of components formed separately and assembled to produce an actuator is within the scope of the invention. A ring mechanism having an actuator shaped differently than illustrated and described herein does not depart from the scope of the invention.

The travel bar includes a cam 281 moveable with the rest of the travel bar 225. In the illustrated embodiment, the cam 281 is a barb extending down from the travel bar 225 through one of the cutouts 129 in the hinge plates 127. As illustrated in FIGS. 10 and 11, the cam 281 has a camming surface 283 at the edge 285 of the opening 129 when the travel bar 225, hinge plates 127, rings 113, and actuator 115 are in their closed positions. For example, in the illustrated embodiment, the camming surface 283 is at the edge 285 of the opening 129 that is closest to the actuator 115. The camming surface 283 is suitably an inclined surface facing generally toward the actuator 115. The inclined camming surface is suitably oriented to extend downward and toward the actuator 115 as the camming surface extends away from the travel bar 225. The camming surface 283 is suitably adapted to remain in contact with the hinge plates 127 at the edge 285 of the opening 129 when the ring mechanism 101 is closed, as illustrated. Because the cam 281 is in contact with the hinge plates 127 at the edge 285 of the opening 129 and movement of the cam farther toward the actuator 115 would require pivoting movement of the hinge plates 127, the spring force from the housing 111 is transmitted from the hinge plates to the cam to resist movement of the cam toward the actuator when the rings are in the closed position. Moreover, the spring force from the housing 111 is suitably transmitted from the cam 281 to the actuator 115 through the travel bar 225 to hold the actuator in its closed position when the rings 113 are in their closed positions. In the illustrated embodiment, the cam 281 is adapted to remain in continuous contact with the hinge plates 127 at the edge 285 of the opening 129 as the rings 113 are moved from their closed position to their open position and from their open position to their closed position. However, it is understood that a gap may sometimes exist between the cam and the hinge plates at the edge of the opening (e.g., when the rings are in the closed position) without departing from the broad scope of the invention.

Figure 12:
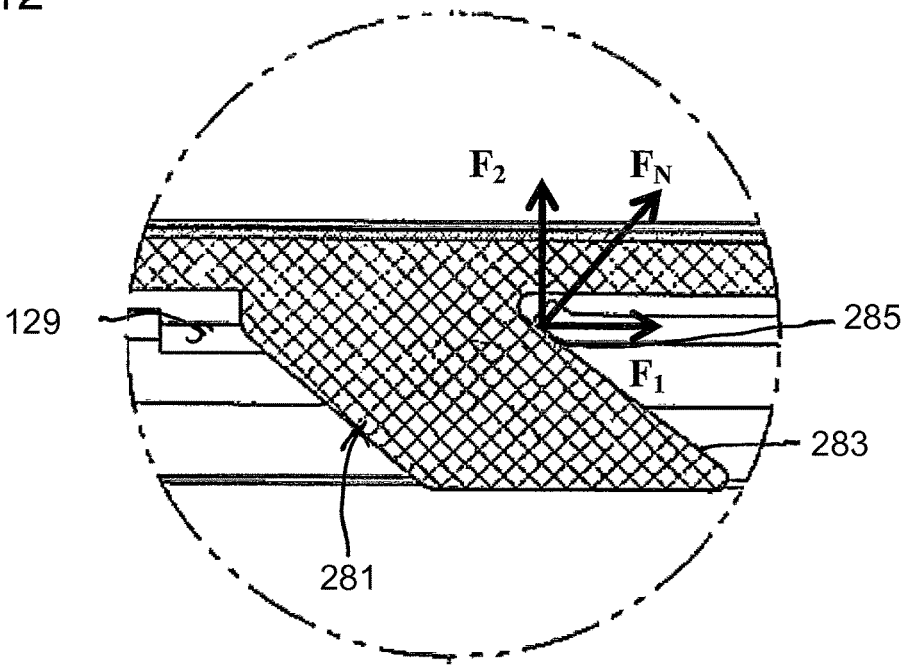

The cam 281 is arranged to help pivot the hinge plates 127 during opening of the rings 113. For example, the cam 281 is suitably arranged so movement of the actuator 115 from its closed position toward its open position causes the camming surface 283 to push upwardly on at least one of the hinge plates 127 (e.g., both hinge plates, as illustrated in FIG. 12) while the opening arm 205 of the actuator is also being push upwardly against at least one of the hinge plates due to rotation of the actuator so the camming surface of the cam and the opening arm of the actuator cooperatively drive pivoting movement of the hinge plates from their closed position against the spring force of the housing 111 to open the rings 113. Referring to the force diagram included in FIG. 12, the camming surface 285 applies a force $F_N$ that is normal to its contact with the upturned edge 285 of the opening 129 in the travel bar. The normal force $F_N$ includes a component $F_1$ that acts in the longitudinal direction and a component $F_2$ that acts in the vertical direction. The vertical force $F_2$ helps drive pivoting motion of the hinge plates 127 during opening.

Figure 13:
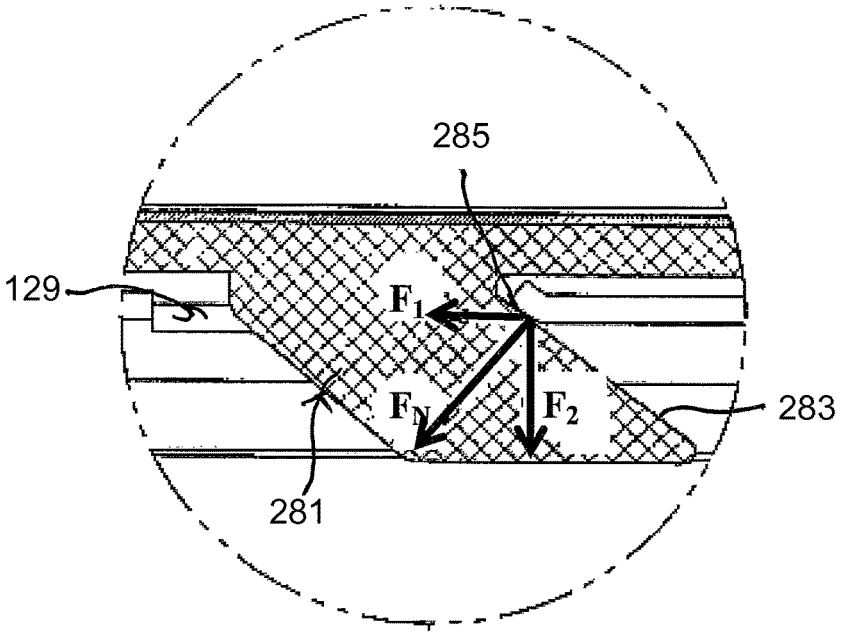
FIGS. 12 and 13 are enlarged fragmentary views of the ring mechanism illustrating forces associated with opening and closing the rings.

The cam 281 is also arranged to help move the travel bar 225 and locking elements 221 into their locked position during closing of the rings, whether the actuator 115 is used to close the rings or a user simply pushes the rings members 133*a*, 133*b* of one or more rings together to close the rings. For example, the cam 281 and hinge plates 127 are suitably arranged so the pivoting movement of the hinge plates from their open position to their closed position causes at least one of the hinge plates (e.g., both hinge plates) to push against the camming surface 283, as illustrated in FIG. 13, and apply a force to the cam tending to move the travel bar 225 and locking elements 221 longitudinally away from the actuator 115 into the locking position. Referring to the force diagram on FIG. 13, the hinge plates 127 apply a force $F_N$ in a normal direction to the contact between the hinge plates and the camming surface 283 at the edge 285 of the opening 127 in the hinge plates. The force $F_N$ includes a component $F_1$ that acts in the longitudinal direction and a component $F_2$ that acts in the vertical direction. The longitudinal force $F_1$ helps drive movement of the travel bar 225 and locking elements 221 to their locking position.

Because the camming surface 283 in the illustrated embodiment is arranged to remain in continuous contact with the hinge plates 127 at the edge 285 of the opening 129 when travel bar 225 is in the locking position and the rings 113 are closed, the cam 281 is arranged to require movement of the travel bar 225 and locking elements all the way to their locking position as the rings 113 are closed. It is not possible to move the hinge plates 127 to their closed position without also moving the travel bar 225 and locking elements 221 to the locked position. In the case where a user closes the rings by moving the ring members 133*a*, 133*b* to close the rings 113, the cam 281 and hinge plates 127 are configured to exert a force ($F_1$ on FIG. 13) the travel bar 225 and locking elements to move them to the locking position and also pull the actuator 115 back to its closed position. In the case where a user rotates the actuator 115 to close the rings 113, the mechanism 101 is adapted so the actuator also pushes against the end of the travel bar 225 so the actuator and hinge plates cooperatively drive movement of the travel bar and locking elements toward the locking position. In this way the cam 281 is adapted to ensure the rings 113 automatically and reliably lock anytime they are closed by ensuring movement of the travel bar 225 and locking elements 221 to the locking position is complete when the rings are closed.

In one embodiment of a method of opening and closing the rings 113 of the ring mechanism 101 a user rotates the actuator 115 from its closed position toward its open position. Consequently, the opening arm 205 of the actuator 115 pushes up against the lower surface of at least one of the hinge plates 127 (e.g., both hinge plates) and begins pivoting the hinge plates against the spring force from the housing 111. At the same time the rotation of the actuator 115 tends to pull the travel bar 225 as well as the locking elements 221 and cam 281 thereon longitudinally in the housing 111 toward the actuator. The camming surface 283 of the cam 281 also pushes up on at least one of the hinge plates 127 (e.g., both hinge plates) at the edge 285 of the opening 129 in the hinge plates to help drive opening movement of the hinge plates. If the user releases the actuator 115 before the hinge plates 127 have passed through their co-planar position, the spring force from the housing 111 drives pivoting movement of the hinge plates 127 back to their closed position and the hinge plates drive the travel bar 225 and locking elements 221 all the way back to their locking position via the cam 281. Once the hinge plates 127 pass through their co-planar position during opening, the direction of the spring force from the housing 111 is reversed and the hinge plates 127 pivot to their open position. Now if the user releases the actuator 115, the hinge plates 127 continue pivoting to the open position until the rings 113 are open due to the housing spring force and push up against the closing arm 203 of the actuator to rotate the actuator to its open position. As this occurs, the actuator 115 pulls the travel bar 225, locking elements 221, and cam 281 to their open position.

To close the rings 113, a user can either use the actuator 115 or simply push two of the ring members 133*a*, 133*b* together. If the user uses the actuator 115, the actuator is rotated from its open position toward its closed position. This causes the closing arm 203 to push downwardly against the upper surface of at least one of the hinge plates 127 (e.g., both hinge plates) and start pivoting the hinge plates toward their closed position against the spring force of the housing 111. It also causes the actuator 115 to push the travel bar, as well as the locking elements 221 and cam 281 thereon longitudinally in the housing 111 away from the actuator toward their locking position. Once the hinge plates 127 pivot through their co-planar position, the direction of the housing spring force reverses and the housing 111 drives pivoting movement of the hinge plates 127 to their closed position. As the hinge plates 127 move to the closed position, they drive the travel bar 225 and locking elements 221 to their locked position via the cam 281, as described above.

On the other hand, if the user closes the rings just by squeezing the ring members 133*a*, 133*b* together, the hinge plates 127 start pivoting from the open position toward the closed position against the spring force from the housing under the influence of the force transmitted through the ring members 133. The hinge plates 127 push against the camming surface 283 of the cam and drive movement of the travel bar 225 and locking elements 221 longitudinally in the housing away from the actuator. The end of the travel bar 225 that is connected to the actuator 115 pulls the actuator toward its closed position. Once the hinge plates 127 pass through the co-planar position, the direction of the housing spring force is reversed and the hinge plates move to their closed position while driving the travel bar 225 and locking elements 221 to their locked position via the cam 281, as described above. Thus, the rings 113 are automatically and reliably locked via the cam 281 no matter which method the user chooses to close the rings 113.

Figure 14:
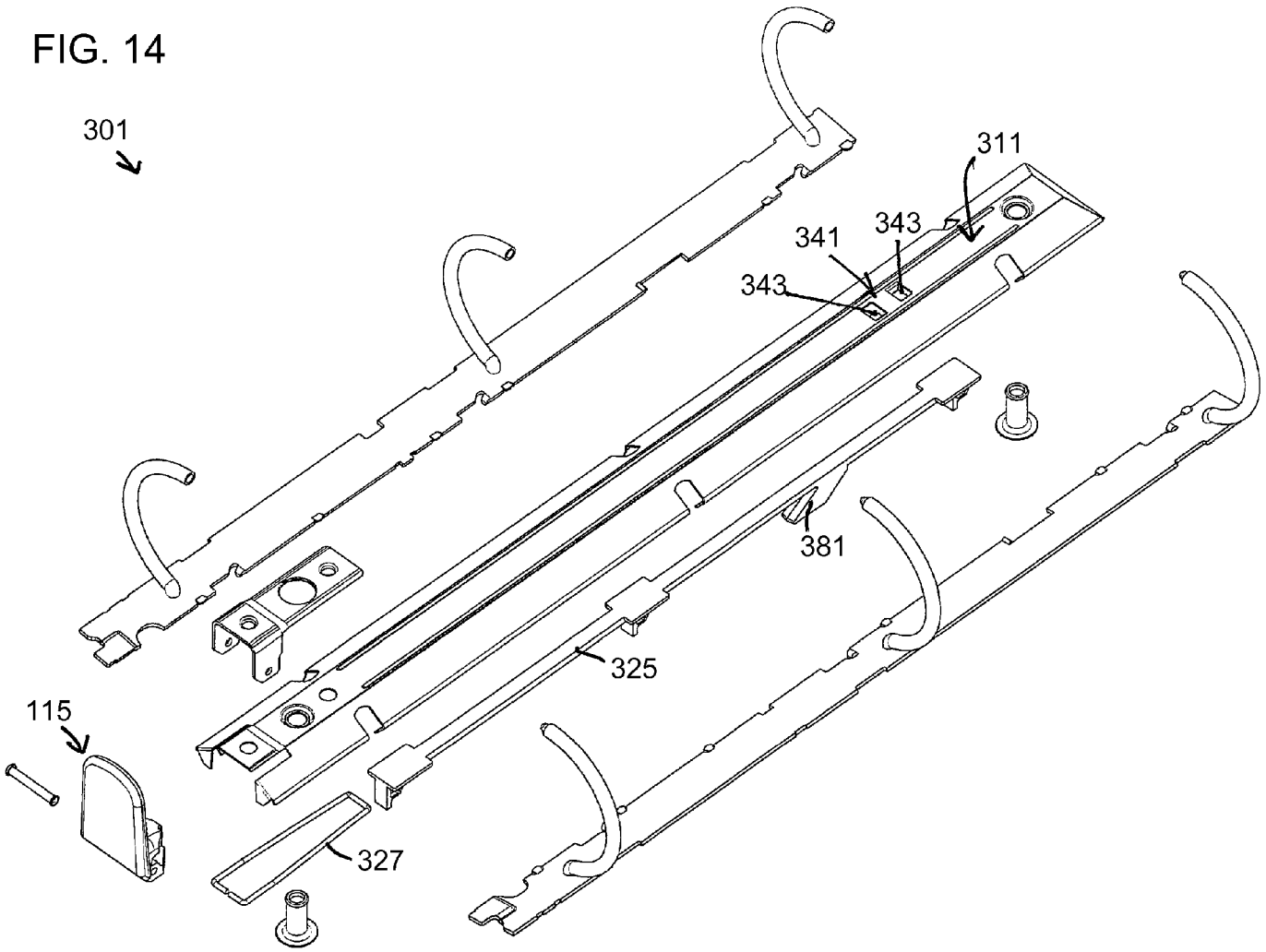
FIG. 14 is an exploded perspective of another embodiment of a ring mechanism of the present invention.
Figure 15:
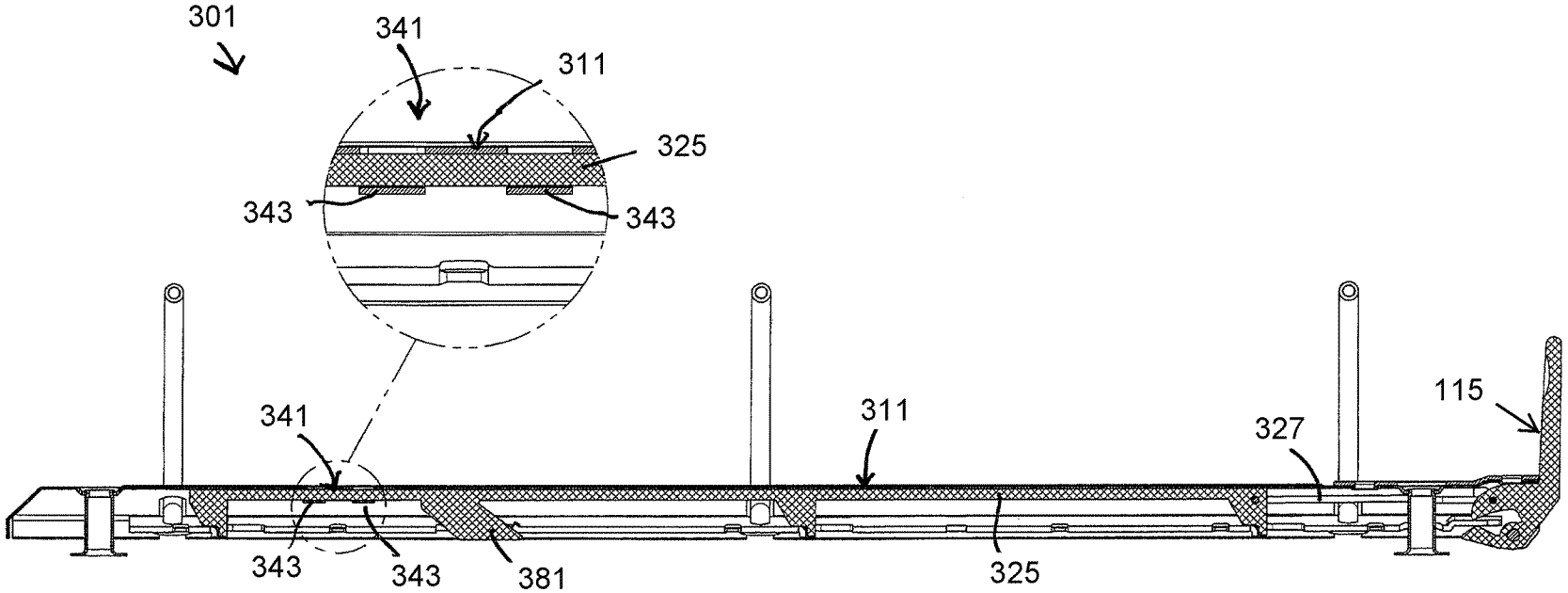
FIG. 15 is a side elevation of the ring mechanism illustrated in longitudinal cross section.
Figure 16:
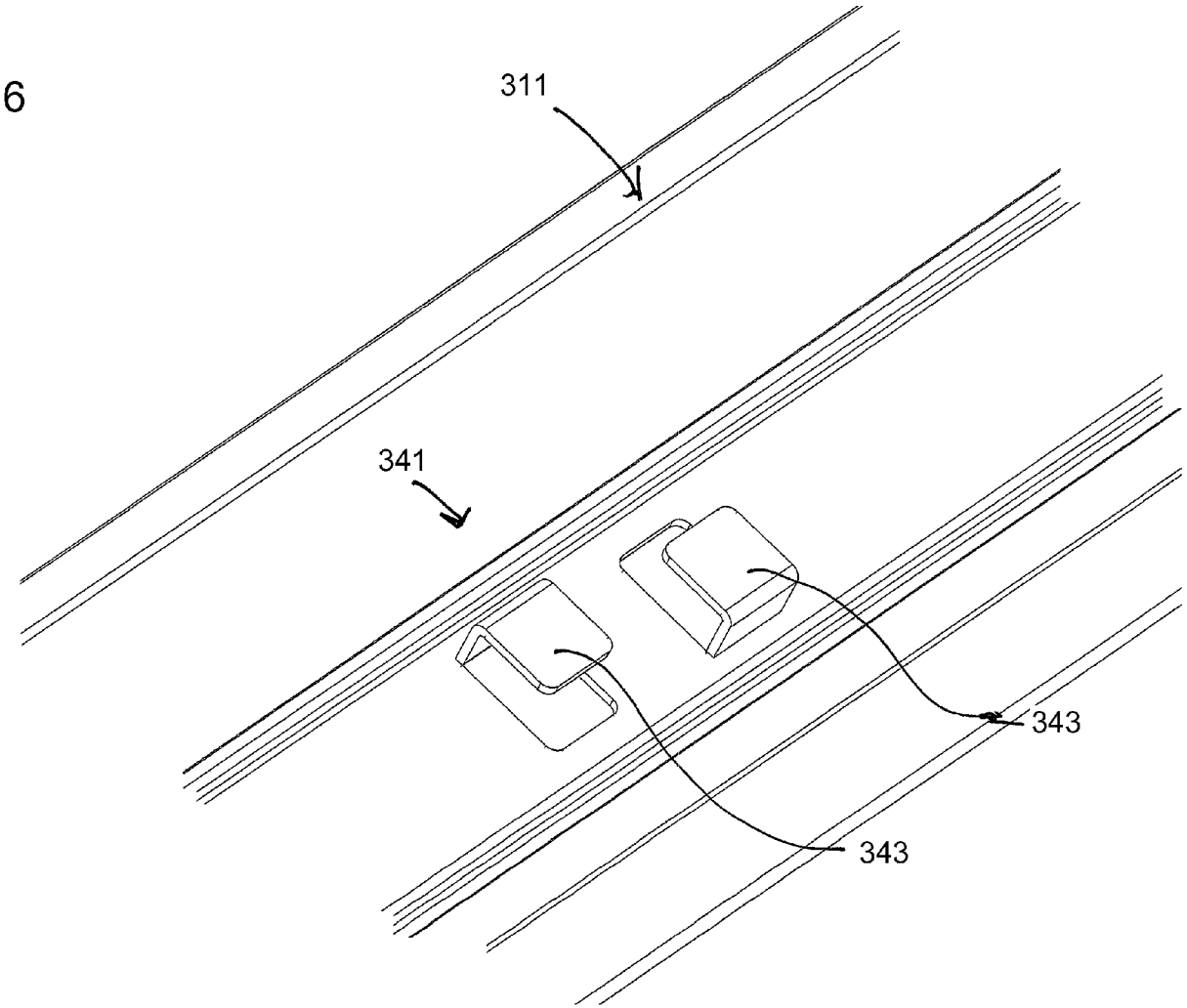
FIG. 16 is a fragmentary perspective of the housing of the ring mechanism illustrated in FIGS. 14 and 15 showing one embodiment of a retaining mechanism.

Another embodiment of a ring mechanism of the present invention, generally designated 301, is illustrated in FIGS. 14-16. This mechanism 301 is substantially identical to the mechanism 101 described above except as noted. One difference is that the intermediate connector portion 227 of the mechanism 101 described above has been replaced with an intermediate connector 327 formed separately from the travel bar 325. In this embodiment, the intermediate connector 327 is a wire link pivotally connected to the actuator 115 and pivotally connected to the travel bar 325 at an end of the travel bar adjacent the actuator. Other intermediate connectors can be used instead without departing from the scope of the invention. The mechanism 301 also has a retaining mechanism 341 on the housing 311 adjacent the cam 381 to reduce flexing in the travel bar 325. As illustrated, the housing 311 has a pair of L-shaped retainers 343 (FIGS. 15 and 16) that extend down from the housing on opposite sides of the travel bar 325 and under the travel bar to hold the portion of the travel bar received in the retainers adjacent the housing. Operation of the mechanism 301 is substantially identical to operation of the mechanism 101 described above except, the retainers 343 resist any force applied by the hinge plates 127 to the cam 381 that would tend to pull the travel bar 325 down away from the housing 311.

When introducing elements of the present invention or the preferred embodiments(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A ring binder mechanism for retaining loose leaf pages, the mechanism comprising:

an elongate housing;

first and second hinge plates supported by the housing for pivoting motion relative to the housing;

rings for holding the loose-leaf pages, each ring including a first ring member and a second ring member, the first ring member being moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

an actuator mounted for movement relative to the housing between open and closed positions of the actuator, the actuator having an opening arm and a closing arm, the hinge plates extending into a notch in the actuator between the opening arm and closing arm so the opening and closing arms can be forced against lower and upper surfaces of the hinge plates, respectively, to pivot the hinge plates by pivoting the actuator; and an elongate travel bar operatively connected to the actuator for movement of the travel bar longitudinally in the housing by rotation of the actuator from its closed position to its open position, the travel bar having a plurality of locking elements and a cam, the locking elements being positioned to block pivoting movement of the hinge plates when the actuator and rings are in the closed position and the locking elements are in a locking position, the cam extending into an opening in the hinge plates and having an camming surface at an edge of said opening when the rings and actuator are in their closed positions, the housing exerting a spring force on the hinge plates that resists movement of the hinge plates toward the open position when the hinge plates are in the closed position and resists movement of the hinge places toward the closed position when the hinge plates are in the open position, wherein movement of the actuator from the closed position to the open position causes the opening arm to push upwardly against a lower surface of at least one of the hinge plates and causes the camming surface of the cam to push upwardly on at least one of the hinge plates so the opening arm on the actuator and the camming surface of the cam cooperatively drive pivoting movement of the hinge plates from their closed position against the spring force of the housing to open the rings.

2. A ring binder mechanism as set forth in claim 1 wherein the housing spring force is transmitted from the hinge plates to the cam to resist movement of the cam toward the actuator when the rings are in the closed position.

3. A ring binder mechanism as set forth in claim 2 wherein the housing spring force is transmitted from the cam to the actuator through the travel bar to hold the actuator in the closed position when the rings are in their closed positions.

4. A ring binder mechanism as set forth in claim 1 wherein the camming surface of the cam is adapted to remain in contact with the hinge plates as the rings are moved from their closed position to their open position and from their open position to their closed position.

5. A ring binder mechanism as set forth in claim 4 wherein movement of the hinge plates from their open position to their closed position causes the hinge plates to push against the camming surface and apply a force to the cam tending to move the travel bar longitudinally away from the actuator.

6. A ring binder mechanism as set forth in claim 5 wherein the mechanism is adapted so rotation of the actuator from its open position to its closed position causes the actuator to push against an end of the travel bar so the actuator and hinge plates cooperatively drive movement of the travel bar and locking elements toward the locking position.

7. A ring binder mechanism as set forth in claim 1 wherein the travel bar extends within the housing between the hinge plates and the housing.

8. A ring binder mechanism as set forth in claim 1 further comprising an intermediate connector connecting the travel bar to the actuator so pivoting movement of the actuator results in linear movement of the travel bar.

9. A ring binder mechanism as set forth in claim 8 wherein the intermediate connector comprises a wire link connecting the travel bar to the actuator.

10. A ring binder mechanism as set forth in claim 1 wherein the camming surface of the cam comprises an inclined surface positioned on a side of the cam facing the actuator, the inclined surface being oriented to extend downward and toward the actuator as the camming surface extends away from the travel bar.

11. A ring binder mechanism as set forth in claim 10 wherein the cam comprises a barb extending down from the travel bar.

12. A ring binder mechanism for retaining loose leaf pages, the mechanism comprising:

an elongate housing;

first and second hinge plates supported by the housing for pivoting motion relative to the housing;

rings for holding the loose-leaf pages, each ring including a first ring member and a second ring member, the first ring member being moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

an actuator mounted for movement relative to the housing between open and closed positions of the actuator, the actuator having an opening arm and a closing arm, the hinge plates extending into a notch in the actuator between the opening arm and closing arm so the opening and closing arms can be forced against lower and upper surfaces of the hinge plates, respectively, to pivot the hinge plates by pivoting the actuator; and an elongate travel bar operatively connected to the actuator for movement of the travel bar longitudinally in the housing by pivoting the actuator, the travel bar having a plurality of locking elements and a cam, the locking elements being positioned to block pivoting movement of the hinge plates when the actuator and rings are in the closed position and the locking elements are in locked position, the cam extending into an opening in the hinge plates and having an camming surface at an edge of said opening when the rings and actuator are in their open positions, the housing exerting a spring force on the hinge plates that resists movement of the hinge plates toward the open position when the hinge plates are in the closed position and resists movement of the hinge places toward the closed position when the hinge plates are in the open position, wherein the cam and hinge plates are arranged so at least one of the hinge plates contacts the camming surface as the hinge plates pivot from the open position to the closed position and exerts a force on the travel bar tending to move the travel bar and locking elements into the locked position.

13. A ring binder mechanism as set forth in claim 12 wherein the housing spring force is transmitted from the hinge plates to the cam to resist movement of the cam toward the actuator when the rings are in the closed position.

14. A ring binder mechanism as set forth in claim 13 wherein the housing spring force is transmitted from the cam to the actuator through the travel bar to hold the actuator in the closed position when the rings are in their closed positions.

15. A ring binder mechanism as set forth in claim 12 wherein the camming surface of the cam is adapted to remain in contact with the hinge plates as the rings are moved from their closed position to their open position and from their open position to their closed position.

16. A ring binder mechanism as set forth in claim 12 wherein the mechanism is adapted so rotation of the actuator from its open position to its closed position causes the actuator to push against an end of the travel bar so the actuator and hinge plates cooperatively drive movement of the travel bar and locking elements toward the locking position.

17. A ring binder mechanism as set forth in claim 12 wherein the travel bar extends within the housing between the hinge plates and the housing.

18. A ring binder mechanism as set forth in claim 12 further comprising an intermediate connector connecting the travel bar to the actuator so pivoting movement of the actuator results in linear movement of the travel bar.

19. A ring binder mechanism as set forth in claim 18 wherein the intermediate connector comprises a wire link connecting the travel bar to the actuator.

20. A ring binder mechanism as set forth in claim 12 wherein the camming surface of the cam comprises an inclined surface positioned on a side of the cam facing the actuator, the inclined surface being oriented to extend downward and toward the actuator as the camming surface extends away from the travel bar.

21. A ring binder mechanism as set forth in claim 20 wherein the cam comprises a barb extending down from the travel bar.

* * * * *